US006729223B2

(12) United States Patent
De Lapasse

(10) Patent No.: US 6,729,223 B2
(45) **Date of Patent: *May 4, 2004**

(54) ATTACHMENT DEVICE FOR OBSERVATION MEANS

(75) Inventor: Géraud De Lapasse, Fontenay le Fleury (FR)

(73) Assignee: Giat Industries (FR)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 10/191,536

(22) Filed: Jul. 10, 2002

(65) Prior Publication Data

US 2003/0010191 A1 Jan. 16, 2003

(30) Foreign Application Priority Data

Jul. 12, 2001 (FR) ..... 01 09288

(51) Int. Cl.[7] ..... F41G 1/00

(52) U.S. Cl. ..... 89/41.17; 89/37.01; 89/41.19; 42/124; 42/111

(58) Field of Search ..... 89/41.17, 37.01, 89/41.19; 42/124, 128, 111

(56) References Cited

U.S. PATENT DOCUMENTS

| | | | | | |
|---|---|---|---|---|---|
| 1,455,929 | A | * | 5/1923 | Neff | 362/268 |
| 2,607,120 | A | * | 8/1952 | Williams | 42/127 |
| 3,504,122 | A | * | 3/1970 | Ratliff | 318/16 |
| 4,570,530 | A | | 2/1986 | Armstrong | 89/41.05 |
| 4,665,795 | A | | 5/1987 | Carbonneau et al. | 89/41.03 |
| 4,934,085 | A | * | 6/1990 | Lough | 42/124 |
| 4,936,190 | A | | 6/1990 | Pilcher, II | 89/41.05 |
| 5,101,590 | A | * | 4/1992 | Hawkins | 42/111 |
| 5,189,245 | A | * | 2/1993 | Bundy | 359/820 |
| 5,704,155 | A | * | 1/1998 | Primeau, IV | 362/110 |
| 6,070,355 | A | * | 6/2000 | Day | 42/106 |
| 6,237,463 | B1 | * | 5/2001 | Grizzaffi | 89/37.01 |
| 6,438,888 | B1 | * | 8/2002 | Lin et al. | 42/114 |

FOREIGN PATENT DOCUMENTS

| | | |
|---|---|---|
| EP | 0 985 897 A2 | 3/2000 |
| GB | 2 259 133 A | 3/1993 |

* cited by examiner

*Primary Examiner*—Michael J. Carone
*Assistant Examiner*—M. Thomson
(74) *Attorney, Agent, or Firm*—Parkhurst & Wendel, L.L.P.

(57) ABSTRACT

The invention relates to an attachment device for observation and/or scrambling or other effect means at the end of the cannon of an armored vehicle.

It incorporates a rigid substantially parallelepiped body, one face of which is shaped to fit the outer wall of the barrel, and constituting a reception cage, said body being connected to the barrel by removable linking means. The observation means are constituted by a day or night-vision camera. The reception cage of the body incorporates at least three cameras.

Application to armored vehicles.

8 Claims, 2 Drawing Sheets

ATTACHMENT DEVICE FOR OBSERVATION MEANS

BACKGROUND OF THE INVENTION

The technical scope of the present invention is that of devices to attach observation means or other to the end of a cannon.

To attach any device to the cannon of an armored vehicle, various means have been proposed, all of which require an intervention on the cannon barrel itself, that is to say the welding of an element. This intervention is likely to affect the properties of the barrel. Thus, patent GB2259133 describes a combat vehicle whose barrel is fitted at its free end with a fin to which a device may be attached. However, attaching and dismounting said device requires tricky manual operations that can only by carried out with the aid of special tooling and are not without operational hazards.

SUMMARY OF THE INVENTION

The aim of the present invention is to supply an attachment device able to be simply attached to and detached from the end of a cannon and ensuring the protection of said device.

The invention thus relates to an observation and/or scrambling or other effect device at the end of the cannon of an armored vehicle, wherein it incorporates a rigid substantially parallelepiped body, one face of which is shaped to fit the outer wall of the barrel, and constituting an equipment housing, said body being connected to the barrel by removable linking means.

According to another characteristic of the invention, the equipment housing of the body incorporates at least three cameras.

According to another characteristic of the invention, the reception cage of the body incorporates at least three cameras.

According to yet another characteristic of the invention, the three cameras are oriented along three different directions to cover a field of observation of approximately 180°.

According to another characteristic of the invention, the three cameras are connected to the monitor of the armored vehicle, said monitor being able to incorporate means to select a single camera.

Preferably, the attachment means are formed of a belt equipped with a frog clamp, also known as a strap clamp.

A first advantage of the device according to the invention lies in the simplicity of its manufacture since the cameras may simply be embedded in the constitutive material of the body.

Another advantage lies in the rapidity of its connection to the barrel.

A further advantage lies in the fact that the body is able to receive any type of device.

BRIEF DESCRIPTION OF THE DRAWINGS

Other characteristics, particulars and advantages of the invention will become more apparent after reading the additional description given hereafter by way of illustration and in relation to the drawings in which.

DETAILED DESCRIPTION OF THE INVENTION

When an armored vehicle is moving over compartmented terrain, the occupants of the vehicle must be able to observe a danger zone without having to venture out of the vehicle. This is the case, for example, when the vehicle must cross a junction, for example in an urban area, on roads in forest or woodland areas. The vehicle is obliged to penetrate into the danger area enough to be able to spot an obstacle and is very vulnerable especially when the turret must be made to pivot. This is why it is preferable for observations to be made in zones that are not directly visible to the crew of the armored vehicles and this in optimal safety conditions. It is naturally possible to attach a scrambling device in order to perturb any launchers that may be on the terrain or any other device allowing other effects such as, for example, the launching of smoke pots or production of flashes of light. In other words, the invention aims to displace to the end of an extension certain operational functions of a vehicle charged with a mission.

Figure 1:
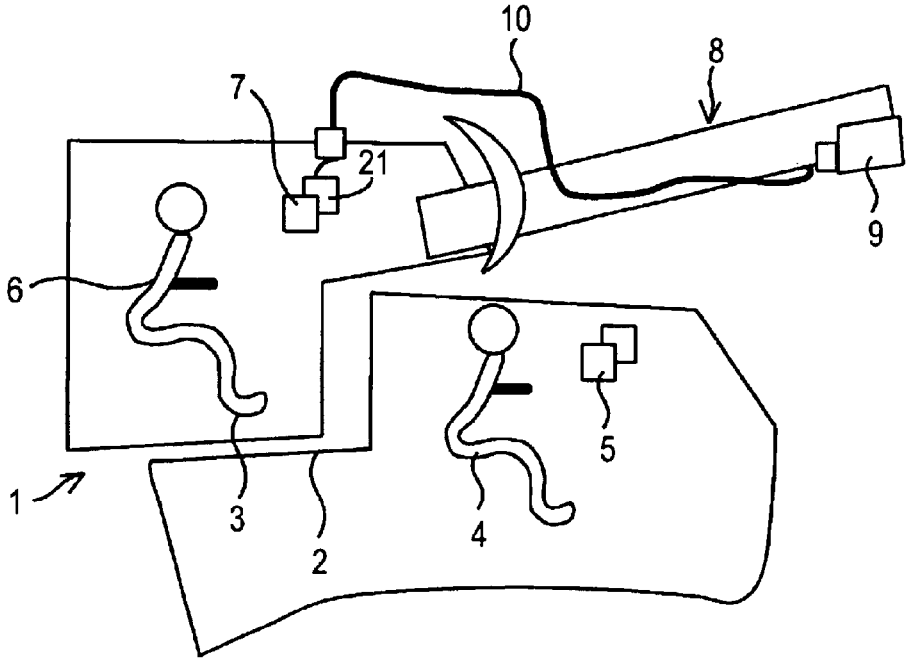
FIG. 1 is a schematic view of the device fastened to the barrel of a cannon.
Figure 4:
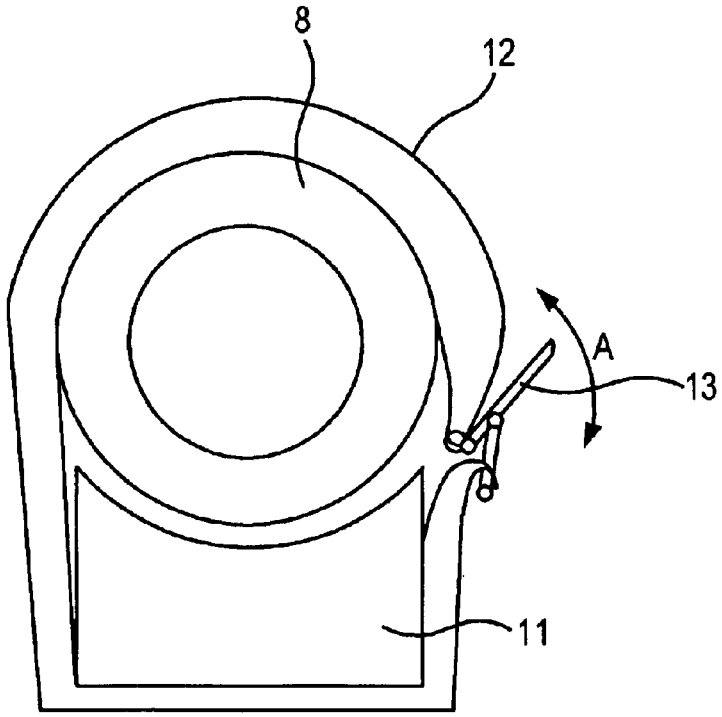
FIG. 4 is a schematic view of the linking means for attachment of a body to a barrel.
Figure 5:
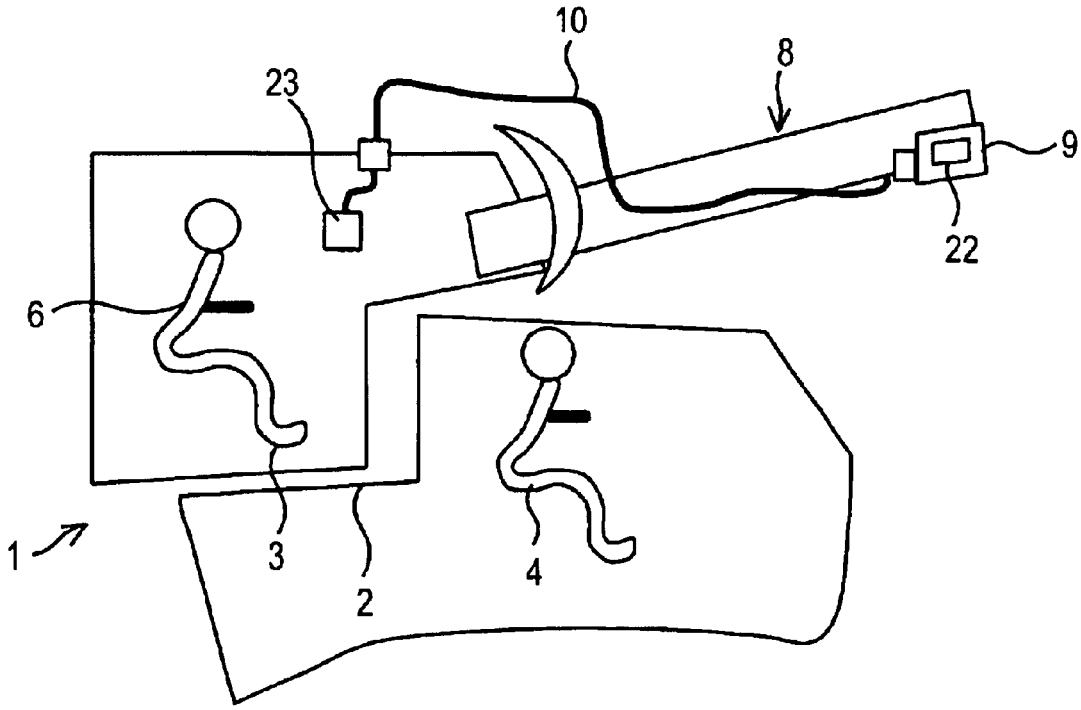
FIG. 5 is a schematic view of the device of FIG. 1 including a scrambler.

FIG. 1 shows a simplified drawing of an armored vehicle 1 comprising a chassis 2 onto which a pivoting turret 3 is mounted. The driver 4 of the vehicle is in the chassis and observes his environment by means of a monitor 5. The vehicle commander 6 is located in the turret 3 and observes his external environment by means of a monitor 7. The turret is equipped with a cannon whose barrel 8 is shown. Monitors 5 and 7 receive pictures classically supplied by a set of cameras. According to the invention, a housing 9 is provided fastened to the end of the barrel and connected by a line 10 to the two monitors 5 and 7. FIG. 4 shows selection means 21, which is any known signal switching device, such as a switching device incorporated into a monitor 23 for viewing images obtained from the cameras, attached to line 10 for operation by the tank commander 6 for selecting one of three camera signals for presentation on monitors 5 and 7.

When the housing 9 encloses a camera, the line 10 may be an optical fiber cable. When the housing 9 encloses a scrambler 22, for example, the line 10 is an electric cable allowing a control signal to be transmitted to trigger the scrambler 22. In operation, the driver 4 advances his vehicle engaging only the end of the barrel in the danger zone. After observation, the commander 6 is able to weigh up the situation.

Figure 2:
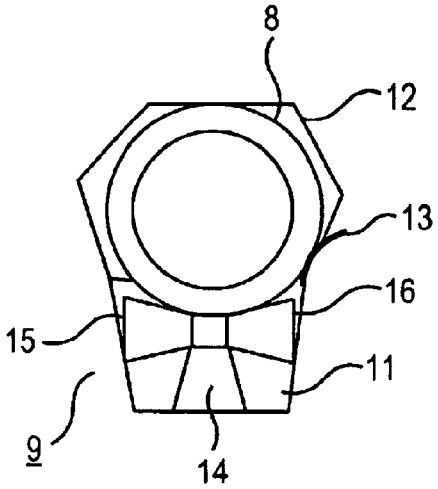
FIG. 2 is across section showing the arrangement of the observation means.

FIG. 2 illustrates the manufacture of a housing comprising three cameras. It is constituted by a body 11 made, for example, of a plastic material connected to the barrel 8 by linking means 12. The linking means are formed of a known strap clamp 12 comprising, for example, a fastener 13 for locking body 11 against barrel 8. The body 11 comprises an equipment housing and encloses three cameras 14, 15 and 16 that between them cover a field of observation of 180°. This field may be oriented in a horizontal or downward direction. Naturally, the field of the three cameras overlaps so as to avoid any blind spots.

Figure 3:
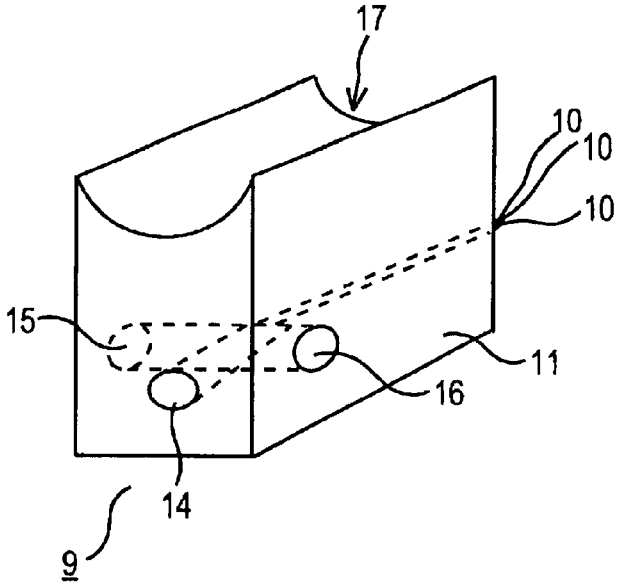
FIG. 3 is a perspective view of the device.

FIG. 3 shows a perspective view of the body 11 showing the outlet opening for the three cameras. We can see that the face 17 of the body 11 is shaped so as to fit around the outer surface of the barrel at the point of attachment. This allows the attachment to be made more reliable. To integrate the cameras in the body 11, the cameras are pre-positioned with their linking cable ensuring full coverage of a field of observation of 180°. The assembly thus produced is then placed in a mould that allows for the outlet opening for the cameras. Molten plastic material is then poured into the mould and allowed to set. By way of a variant, a solid body may be produced that is then machined to obtain the three female threadings intended for the cameras and the one allowing the linking cable to be connected to the monitors.

What is claimed is:

1. A removable, rapidly attachable device in combination with a cannon barrel of an armored vehicle, comprising:

a rigid, substantially parallelepiped body having an arcuate shaped face for fitting to an outer wall of the barrel, and comprising a housing for holding equipment; and linking means comprising a strap and clamp for easily removably linking said body to the barrel by a single clamping operation.

2. The attachment device according to claim 1, wherein said equipment comprises image sensing means for observation.

3. The attachment device according to claim 2, wherein said image sensing means comprises at least three cameras.

4. The attachment device according to claim 3, wherein said three cameras are oriented along three different directions to cover a field of observation of approximately 180°.

5. The attachment device according to claim 4, wherein said three cameras are connected to a monitor.

6. The attachment device according to claim 5, wherein said monitor incorporates selection means for selecting a single camera.

7. The attachment device according to claim 2, wherein said image sensing means for observation comprises one of a day or night-vision camera.

8. The attachment device according to claim 1, wherein said equipment comprises scrambling means for perturbing a function of other equipment.

* * * * *